US009457875B2

(12) United States Patent
Zheng et al.

(10) Patent No.: US 9,457,875 B2
(45) Date of Patent: Oct. 4, 2016

(54) FLOATING TYPE SELF-LIFTING DRILLING PLATFORM

(71) Applicant: Graduate School at Shenzhen, Tsinghua University, Shenzhen (CN)

(72) Inventors: Xiangyuan Zheng, Shenzhen (CN); Daoyi Chen, Shenzhen (CN); Han Yu, Shenzhen (CN)

(73) Assignee: Graduate School at Shenzhen, Tsinghua University, Shenzhen (CN)

( * ) Notice: Subject to any disclaimer, the term of this patent is extended or adjusted under 35 U.S.C. 154(b) by 0 days.

(21) Appl. No.: 14/983,351

(22) Filed: Dec. 29, 2015

(65) Prior Publication Data

US 2016/0229497 A1 Aug. 11, 2016

Related U.S. Application Data

(63) Continuation of application No. PCT/CN2015/075486, filed on Mar. 31, 2015.

(30) Foreign Application Priority Data

Feb. 9, 2015 (CN) ..... 2015 1 0066944

(51) Int. Cl.
*E02B 17/02* (2006.01)
*B63B 35/44* (2006.01)
*E21B 7/128* (2006.01)

(52) U.S. Cl.
CPC ..... *B63B 35/4413* (2013.01); *B63B 35/44* (2013.01); *E21B 7/128* (2013.01); *B63B 2035/448* (2013.01)

(58) Field of Classification Search
CPC ..... E02B 17/021; E02B 2017/006
USPC ..... 405/196; 114/265
See application file for complete search history.

(56) References Cited

U.S. PATENT DOCUMENTS

| | | | |
|---|---|---|---|
| 3,872,679 | A | 3/1975 | Fischer |
| 3,915,108 | A | 10/1975 | Rodriguez |
| 6,139,224 | A | 10/2000 | Michel et al. |

FOREIGN PATENT DOCUMENTS

| | | |
|---|---|---|
| CN | 1404452 | 3/2003 |
| CN | 201614004 | 10/2010 |

(Continued)

OTHER PUBLICATIONS

International Search Report and Written Opinion, issued in the corresponding International Application No. PCT/CN2015/075486, dated Nov. 6, 2015, 12 pages.

(Continued)

*Primary Examiner* — Tara M. Pinnock
(74) *Attorney, Agent, or Firm* — Hamre, Schumann, Mueller & Larson, P.C.

(57) ABSTRACT

A floating type self-lifting drilling platform includes a main deck, a floating cushion, pile legs, a lifting mechanism and a mooring system. The area and thickness of the floating cushionare both greater than those of the main deck, the middle part is provided with a moon pool, and the inner part is partitioned into multiple cabins; there are three pile legs, the pile legs are truss structures, the bottom part of each of the pile legs is rigidly connected with the floating cushion, and the main deck lifts vertically along the pile legs through the lifting mechanism and is fixed at a preset height; each pile leg includes upper and lower hollow sealing bodies; the water line is located in the height range of the upper section during the operation and positioned through the mooring system.

19 Claims, 6 Drawing Sheets

(56) References Cited

FOREIGN PATENT DOCUMENTS

| | | |
|---|---|---|
| CN | 102089493 | 6/2011 |
| CN | 102438890 | 5/2012 |
| CN | 202765254 | 3/2013 |
| CN | 103052751 | 4/2013 |
| CN | 203698619 | 7/2014 |
| CN | 204489132 | 7/2015 |
| GB | 2350326 | 11/2009 |
| WO | 2011126844 | 10/2011 |

OTHER PUBLICATIONS

Chinese Office Action issued in the corresponding Chinese Patent Application No. 201510066944.3, dated May 23, 2016, 12 pages.

M. Eng, "The Primary Research of Deepwater Semi-submersible Drilling Platform on General Design and Ballast System", Dissertation for the Degree, Harbin Engineering University, Jan. 2011, 80 pages.

FLOATING TYPE SELF-LIFTING DRILLING PLATFORM

BACKGROUND

1. Technical Field

The present application relates to offshore oil and gas drilling devices, and in particular, to a floating type self-lifting drilling platform.

2. Related Art

In the current trend of increasing energy demands in the world and gradually running out onshore oil and gas resources, exploring broader energy supply ways has become a key point of development all over the world. The offshore oil and gas exploration technology is developed especially rapid. The proportion of the total yield of the offshore oil and gas in the total yield of the oil and gas in the world has increased from 20% in 1997 to more than 40% in nowadays, where the yield of deep water oil and gas accounts for about more than 30% of the yield of the offshore oil and gas. Therefore, for three offshore drilling devices, including a self-lifting type drilling platform, a semi-submersible type drilling platform and a drilling ship, operation in deepwater is a main development tendency.

The self-lifting type drilling platforms account for more than 60% of the total number of offshore drilling devices, and dominate the offshore oil and gas development for more than a hundred years. However, the platforms have the current operation water depth not exceeding 150 meters, and mainly operate on continental shelves of the continents. The self-lifting type drilling platform is formed by an upper layer platform and several lifting pile legs. Before operation, the platform is towed to a well position through self-propulsion or by a towboat. After being positioned, a pile leg lifting device inserts pile shoes under the pile legs into the seabed for fixation, the upper layer platform is lifted to a certain height above the sea surface, and a cantilever tower is extended from a deck to conduct the drilling operation. The self-lifting type drilling platform has characteristics such as good stability, good flexibility, and the cost lower than that of the semi-submersible type drilling platform and the drilling ship. However, the operation during positioning or dislocation of the platform is complicated, and the platform is sensitive to the wave. Moreover, as the water depth is increased, the cost is increased significantly.

For the sea area having the water depth of more than 200 meters, the existing floating platforms have respective limits. In fact, there are a large amount of oil and gas resources to be developed in the water area of 200 meters to 500 meters. If a semi-submersible type drilling platform and a drilling ship are newly built for a new oil production region with the water depth of 200 to 500 meters, requirements on exploration technologies and constructions may be met, but the cost is huge, it may be overkill, and has a poor economical efficiency. On the other hand, the number of existing self-lifting type drilling platforms is large, but a lot of the platforms in service cannot be continuously used due to the service lives of pile legs and pile shoes, and there will be a large number of self-lifting type drilling platforms retire in future ten years. Therefore, how to modify the lower part structures of the platforms by using the existing mature technologies to prolong the service lives thereof and enable them to operate in the sea area with the water depth of exceeding 150 meters will be a great technical breakthrough. Moreover, a large market of offshore engineering device modification is formed in the shipbuilding industry, which has a considerable economic prospect.

SUMMARY

To overcome the defects of the prior art, the present application provides a floating type self-lifting drilling platform.

The technical problems of the present application are solved by using the following technical solutions:

A floating type self-lifting drilling platform, comprising: a main deck, a floating cushion, pile legs, a mooring system and a lifting mechanism;

wherein the floating cushion is located under the main deck, the area and thickness of the floating cushion are both greater than those of the main deck, a middle part of the floating cushion is provided with a moon pool as a passage, and the inner part of the floating cushion is partitioned into multiple cabins;

wherein there are three pile legs, a main structure of each of the pile legs is a triangular truss structure, a bottom part of each of the pile legs is rigidly and fixedly connected with the floating cushion, the main deck lifts vertically along the pile legs through the lifting mechanism and is fixed at a preset height, each of the pile legs comprises an upper hollow sealing body, a lower hollow sealing body and a middle section, the upper hollow sealing body and the lower hollow sealing body are both formed by soldering steel plates along the triangular truss structure, the middle section is located between the upper hollow sealing body and the lower hollow sealing body, and the middle section is still of a triangular truss structure through which water can pass; and wherein during the operation, the center of gravity of the floating type self-lifting drilling platform is lower than the centre of buoyancy, and the water line is located within the height range of the upper hollow sealing body and is positioned through the mooring system.

In the foregoing technical solution:

During the operation, the floating cushion and the pile legs provide the buoyancy force, and the centre of buoyancy is higher than the center of gravity. The floating cushion replaces pile shoes commonly used in a self-lifting type drilling platform, and the area and thickness of the floating cushion are greater than those of the main deck, thereby providing the major buoyancy force for wet towing and normal operation of the platform in the water. Moreover, the center of the floating cushion is provided with the moon pool, so that the production device and drilling device of the traditional self-lifting type drilling platform may be continuously used effectively through the drilling tool and/or production device. Further, the floating cushion is fixedly connected to the bottom parts of the pile legs, the total length of the pile leg is large enough, so that the platform has a deep draft, and the draft exceeds 90 meters; therefore, the lateral wave force subjected by the floating cushion is greatly reduced. Moreover, the floating cushion has a huge area and becomes a heave plate, the heave damping is thereby increased, so that the vertical heaving movement is greatly reduced, which is more conducive to the offshore operation of the platform. Furthermore, during towing, the main deck is lowered to be overlapped with the upper part of the floating cushion, and compared with the traditional self-lifting type drilling platform, the center of gravity of the platform is lower, and the towing stability is better.

There are three pile legs, and the pile legs not only support the total weight of the main deck and devices thereon, but also provide a part of buoyancy force of the platform of the present application. The lifting mechanism enables the main deck to lift vertically along the pile legs, thereby implementing adjustment of the gap height between the main deck and the sea surface in a storm, without the need of adjusting the draft of the platform. Each of the pile legs is of a triangular spatial truss structure, the upper hollow sealing body and lower hollow sealing body of the pile leg are both formed by soldering steel plates along the truss structure, the structural strength of the pile leg is improved because of the upper and lower hollow sealing bodies. During the operation, the water line is always located in the height range of the upper hollow sealing body of the pile leg, and distances between the three pile legs are large, so that the restoring moment and stability of the platform are increased. The platform uses three triangular pile legs, and will not generate vortex strike movements.

Preferably, the port, starboard and stern of the floating cushion are correspondingly parallel to the port, starboard and stern of the main deck; and the front end of the floating cushion is an inclined surface tilting inwards from the top surface of the floating cushion towards the bottom surface of the floating cushion.

The foregoing technical solution can reduce the water resistance of the whole platform during self-propulsion and towing.

Preferably, the cabins in the floating cushion include an oil storage cabin, a water ballast cabin, a pump cabin and a sealed cabin, and the sealed cabin is filled with solid high-density metal.

The floating cushion has a huge volume, and the internal thereof is partitioned into multiple cabins for storing oil and serving as a water ballast cabin. A part of structure of the floating cushion is filled with solid high-density metal, so that the center of gravity of the whole platform is lowered to be lower than the floating center, thereby implementing the unconditional stable of the platform.

Preferably, the lower hollow sealing body is communicated with the internal of the floating cushion, the internal of the lower hollow sealing body is also partitioned into cabins, and the cabins in the lower hollow sealing body include a water ballast cabin or an oil storage cabin.

The lower hollow sealing body is served as water ballast cabins or oil storage cabins, thereby further lowering the center of gravity of the platform, and improving the stability during the operation.

Preferably, the floating type self-lifting drilling platform further includes a propeller, and the propeller is disposed at the outer side of the stern of the main deck.

The propeller disposed at the outer side of the stern of the main deck enables the platform to move in a short distance and adjusts a moving direction of the platform, thereby improving the flexibility of small-range movement of the platform, and reducing the towing difficulty. When the platform drills multiple wells, it is only needed to retract the anchor chains, the platform can move to the above of a new well through self-propulsion.

Preferably, the angle of inclination of the inclined surface is 30° to 60°.

Preferably, the mooring system is a multi-anchor chain distributed mooring system, at least two anchor chains are connected to the upper hollow sealing body of each pile leg, and at least six anchor chains are connected to the floating cushion.

Preferably, the pile legs are arranged into triangles, and are symmetric at the port and the starboard.

Preferably, when the floating type self-lifting drilling platform includes the production module, the production module includes a dry-type tree production system.

Preferably, when the floating type self-lifting drilling platform encounters a storm during the operation, the floating type self-lifting drilling platform keeps the draft, and the lifting mechanism lifts the main deck to adjust the gap height between the main deck and the sea surface.

The present application further has the following advantages: compared with the traditional self-lifting type platform, the present application is of a floating type, and the body of the platform is not contacted with a seabed during the operation, so that the platform is applicable to oil gas drilling and exploration at the sea area having the water depth within 500 meters, and is particularly applicable to the water depth of 200-500 meters. The drilling platform of the present application is especially applicable to modification of commissioned self-lifting type drilling platforms, the main decks and modules configured on the main decks of most commissioned self-lifting type drilling platforms may be reserved. A floating cushion provided with a moon pool is used to replace the pile shoes of the conventional self-lifting type drilling platform, and the pile legs are improved, so that after the modification, a floating drilling and/or production device may be achieved, which has greatly increased depth and range of operation sea area, and breaks through the current limit of the water depth not exceeding 150 meters. During the operation, the floating cushion and the pile legs provide the buoyancy force, the centre of buoyancy is higher than the center of gravity, the stability is good, and because the platform has a deep draft, the floating cushion is subjected to a small wave force, the movement performance is good, and the floating cushion meanwhile has a large oil storage capability. During towing, the floating cushion can improve the stability of the towing.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

Figure 1:
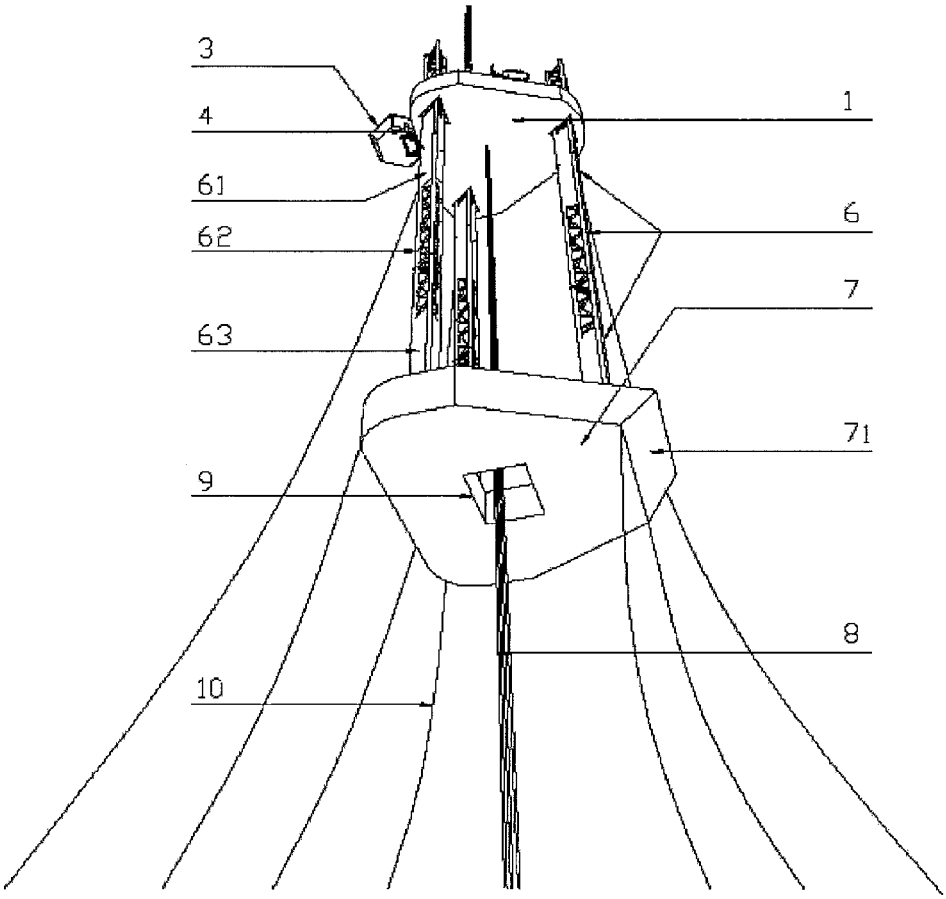
FIG. 1 is a schematic three-dimensional diagram of a floating type self-lifting drilling platform according to a preferred embodiment of the present application.
Figure 2:
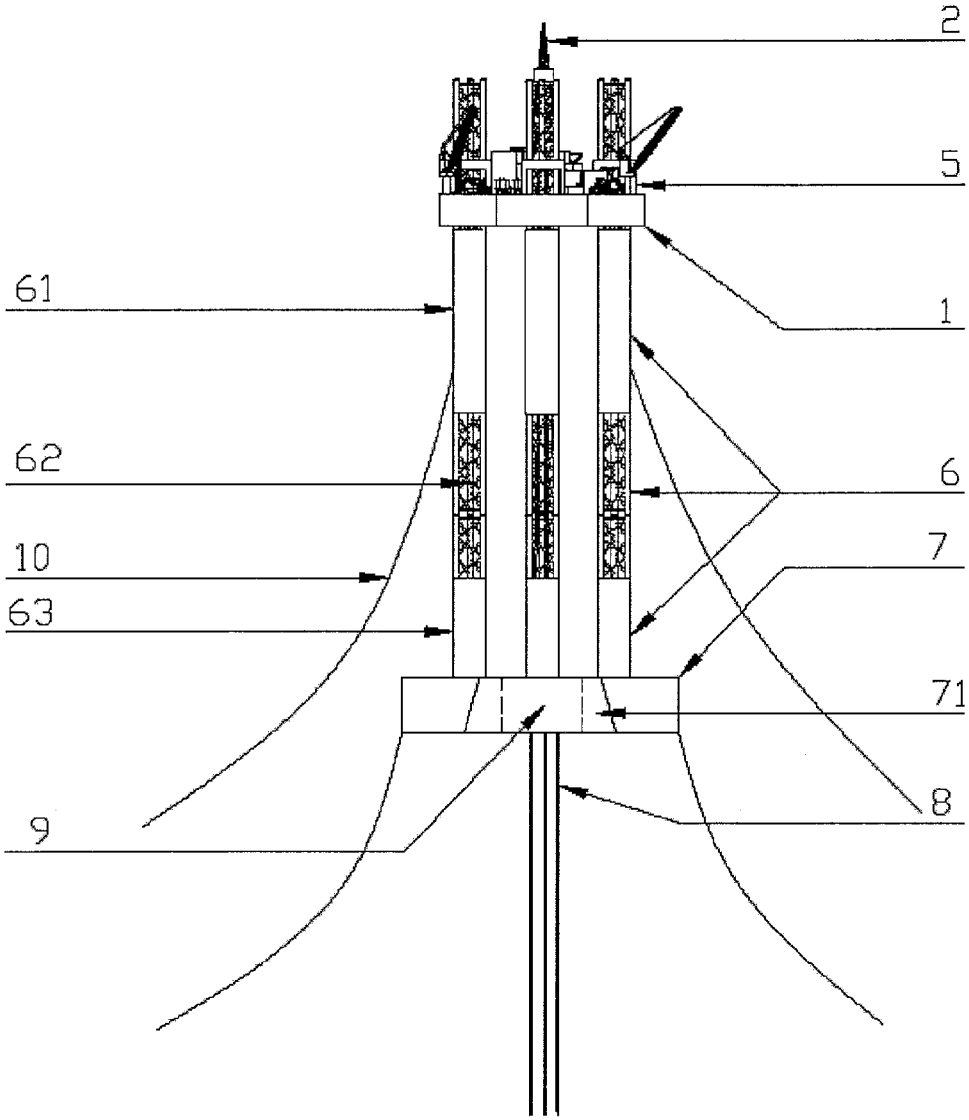
FIG. 2 is a front view of a floating type self-lifting drilling platform according to a preferred embodiment of the present application.
Figure 3:
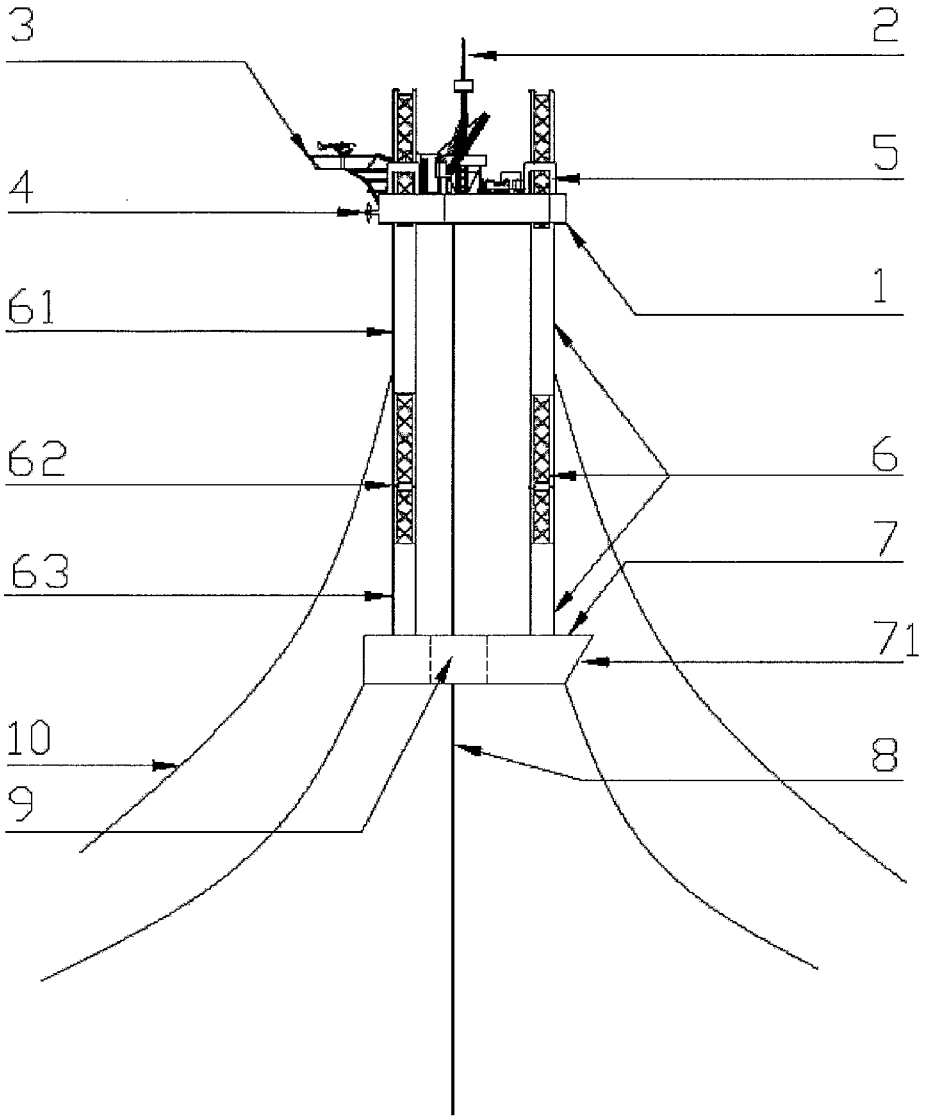
FIG. 3 is a side view of a floating type self-lifting drilling platform according to a preferred embodiment of the present application.
Figure 4:
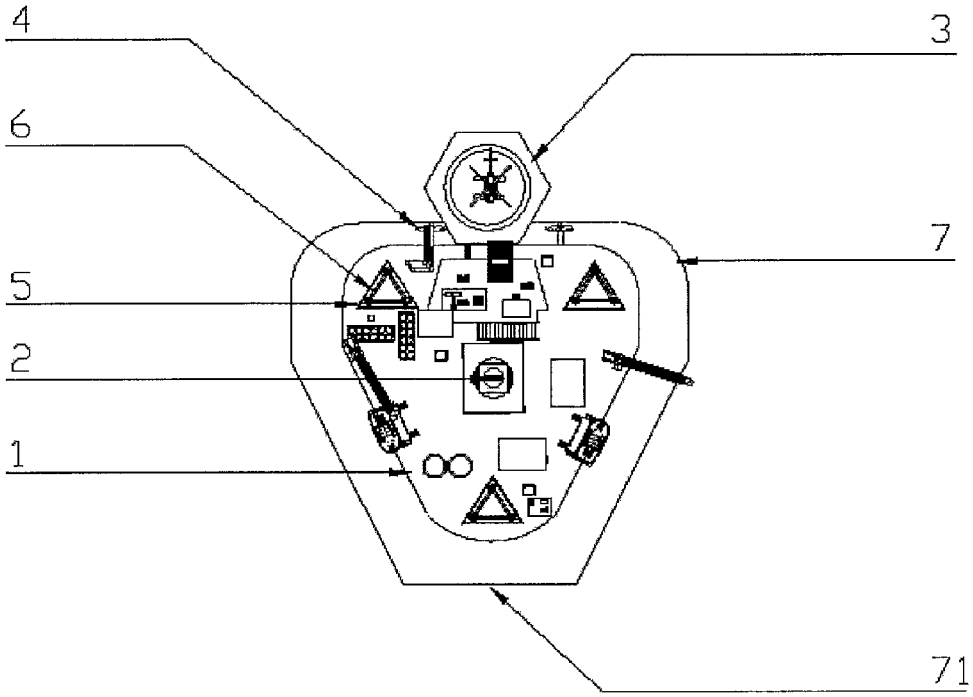
FIG. 4 is a top view of a floating type self-lifting drilling platform according to a preferred embodiment of the present application.

In order to make objectives, technical solutions and advantages of embodiments of the present application more clearly, the technical solutions in the preferred embodiments of the present application are described clearly and completely in the following through the accompanying drawings.

A floating type self-lifting drilling platform (briefly referred to as a platform) of the present application may be merely used for drilling, merely used for production, or may be used for drilling and production at the same time. The present application being used for drilling and production at the same time is used as an example for illustration in the following.

As shown in FIG. 1 to FIG. 4, in a preferred embodiment, the platform includes: a main deck 1 and an upper structure thereof, a floating cushion 7, pile legs 6, a mooring system, a lifting mechanism 5, and a propeller 4, where the upper structure on the main deck 1 may include modules such as a drilling module, a production module, a living module, a power module, a lifesaving module, and a helicopter deck. The drilling module may include drilling tools such as a drill bit, a drill pipe and a drill string, and the production module may include a production device such as a stand pipe. For illustration purpose, in the following embodiment, reference 8 refers to a drilling and production module. In another embodiment, reference 8 may also refer to the drilling module. In another embodiment, reference 8 may also refer to the production module.

The major plane of the main deck 1 is triangular having approximately rounded angles, and is symmetric at the port and at the starboard. The drilling module is located at or closes to a geological center of the main deck 1, and during a drilling operation, trip the drilling and production module 8 (i.e, trip the drilling tools such as a drill bit, a drill pipe and a drill string; and the production device such as a stand pipe) from a drill tower 2 located above the middle part of the main deck 1, and pass through the moon pool 9 at the center of the floating cushion 7 to conduct drilling and production operations. The traditional cantilever beam extending out of the main deck is no longer used, which endangers the stability of the platform. The helicopter deck 3 is located above the stern of the main deck 1. The propeller 4 is located at the outer side of the stern of the main deck 1, and is used to enable the platform to move in a short distance, and adjust the moving direction of the platform, thereby improving the flexibility of the platform moving in a small range, and reducing the difficulty in towing. After the propeller 4 is disposed, when drilling multiple wells, the platform only needs to retract the anchor chains 10, and moves to the above of a new well through self-propulsion with the propeller 4 or towing.

There are three pile legs 6, major structures of the pile legs are all triangular spatial truss structures, and the pile legs are respectively disposed at three corners of the main deck, arranged in a triangular form, and are symmetric at the port and at the starboard. The pile legs 6 not only support the total weight of the main deck 1 and various modules in the upper structure thereof, but also provide a part of buoyancy force of the platform. The bottom part of each pile leg 6 is rigidly and fixedly connected with the floating cushion 7, the total length of the pile leg is large enough, so that the platform draft is deep, and the lateral wave force subjected by the floating cushion 7 is significantly reduced. By using the lifting mechanism 5, the main deck 1 may vertically lift along the height direction of the pile legs 6, and is fixed at a preset height of the pile legs 6; in this way, when the platform encounters a storm during the operation, the platform may keep the original draft, and the lifting mechanism 5 may lift the main deck 1 to adjust the gap height between the main deck 1 and the sea surface, without the need of adjusting the draft of the platform. Each pile leg 6 includes an upper hollow sealing body 61, a middle section 62 and a lower hollow sealing body 63 along the height direction. The middle section 62 is located between the upper hollow sealing body 61 and the lower hollow sealing body 63, and is still of a triangular truss structure through which sea water can pass. In the height direction, the upper hollow sealing body 61 is close to the main deck 1, and the lower hollow sealing body 63 is close to the floating cushion 7. The upper hollow sealing body 61 and the lower hollow sealing body 63 are both formed by soldering steel plates along the triangular truss structure, and may provide the buoyancy force. During the operation of the platform, the water line is always located in the height range of the upper hollow sealing body 61. The internal of the lower hollow sealing body 63 may be configured to be communicated with the internal of the floating cushion 7, and in this way, the internal of the lower hollow sealing body 63 may also be partitioned into multiple cabins, including water ballast cabins or oil storage cabins, thereby further lowering the center of gravity of the platform, and improving the stability of the platform during the operation. The structural strength of the pile leg is improved because of the upper and lower hollow sealing bodies. Distances between the three pile legs are large, so that the restoring moment and stability of the platform are increased. The platform uses three triangular pile legs, and will not generate vortex strike movements.

The floating cushion 7 is located under the main deck 1, the port of the floating cushion 7 is parallel to the port of the main deck 1, the starboard of the floating cushion 7 is parallel to the starboard of the main deck 1, and the stern of the floating cushion 7 is parallel to the stern of the main deck 1; in other words, the floating cushion 7 and the main deck 1 have similar shapes, but a front end 71 of the floating cushion is an inclined surface tilting inwards from the top surface of the floating cushion toward the bottom surface of the floating cushion. The area and thickness of the floating cushion 7 are both greater than those of the main deck 1, the floating cushion 7 provides the main buoyancy force for wet towing and normal operation of the platform in the water, and therefore, during the operation of the platform, the buoyancy force is mainly provided by the floating cushion, the upper hollow sealing body and the lower hollow sealing body together. The front end 71 of the floating cushion 7 is an inclined surface tilting inwards from the top surface of the floating cushion toward the bottom surface of the floating cushion, and the angle of inclination of the inclined surface is preferably 30° to 60°, so as to reduce the water resistance during self-propulsion or towing of the platform. The moon pool 9 is disposed at the middle part of the floating cushion 7, and the dry-type tree system of the traditional self-lifting type drilling platform may still be used effectively by using the drilling and production device 8. The floating cushion 7 has a large volume, and the internal thereof is partitioned into multiple cabins, including an oil storage cabin, a water ballast cabin, a pump cabin and a sealed cabin, and the sealed cabin is filled with solid high-density metal, so that the center of gravity of the whole platform is lowered to be lower than the centre of buoyancy, thereby improving the stability of the platform. The high-density metal refers to metal whose density is greater than 8 g/cm$^3$, for example, plumbum. Meanwhile, the floating cushion 7 has a huge area and becomes a heave plate, the heave damping is thereby increased, so that the vertical heaving movement of the platform is greatly reduced, which is more conducive to the offshore operation of the dry-type tree system. Further, during towing, the main deck 1 is lowered to be overlapped with the upper part of the floating cushion 7, and compared with the traditional self-lifting type drilling platform, the center of gravity of the platform is lower, and the towing stability is better.

The mooring system is used to position the platform during the operation of the platform, and includes devices such as an anchor, an anchor chain, a chain cable fairlead, and a windlass. During the operation, a multi-anchor chain distributed mooring system may be used. The specific number of anchor chains 10 may be determined according to actual conditions, and preferably, least two anchor chains are connected to the upper hollow sealing body 61 of each pile leg, at least six anchor chains are connected to the floating cushion, and the lower end of the anchor chain 10 extend to the seabed and is fixed by the anchor.

Figure 5:
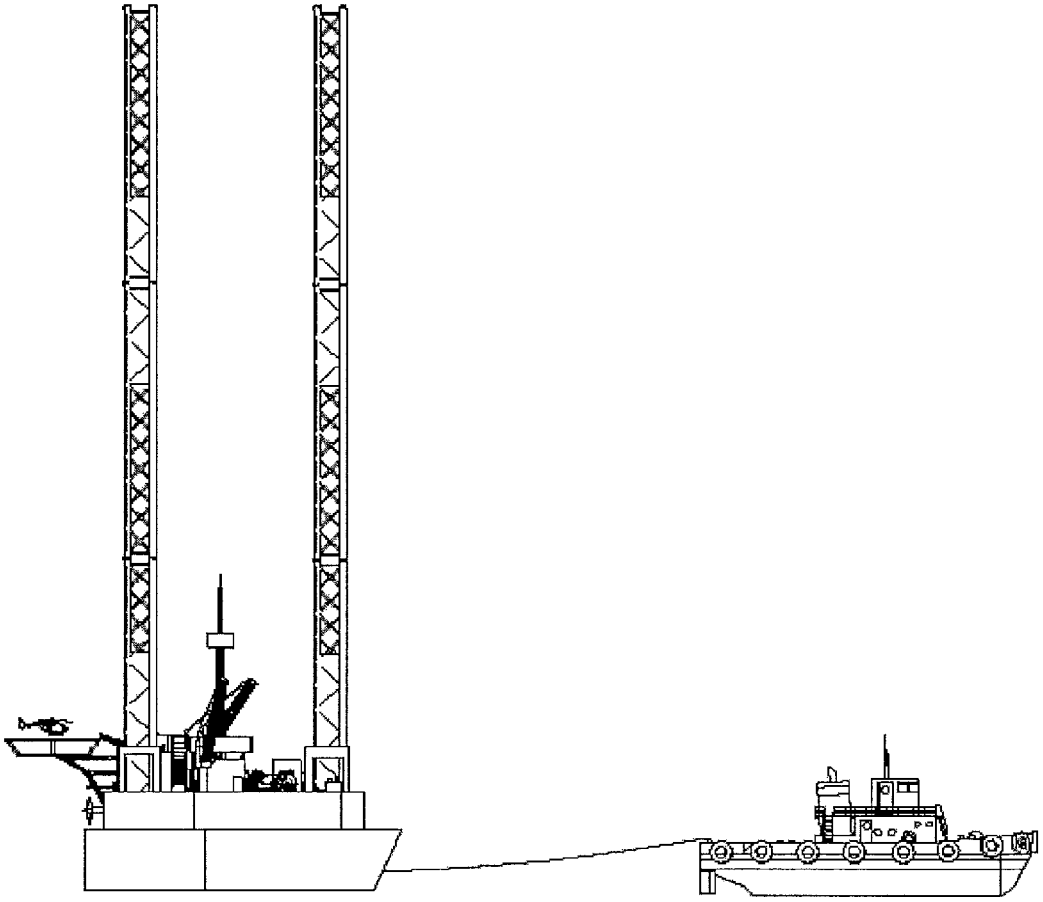
FIG. 5 is a side view of wet towing of a floating type self-lifting drilling platform according to a preferred embodiment of the present application.
Figure 6:
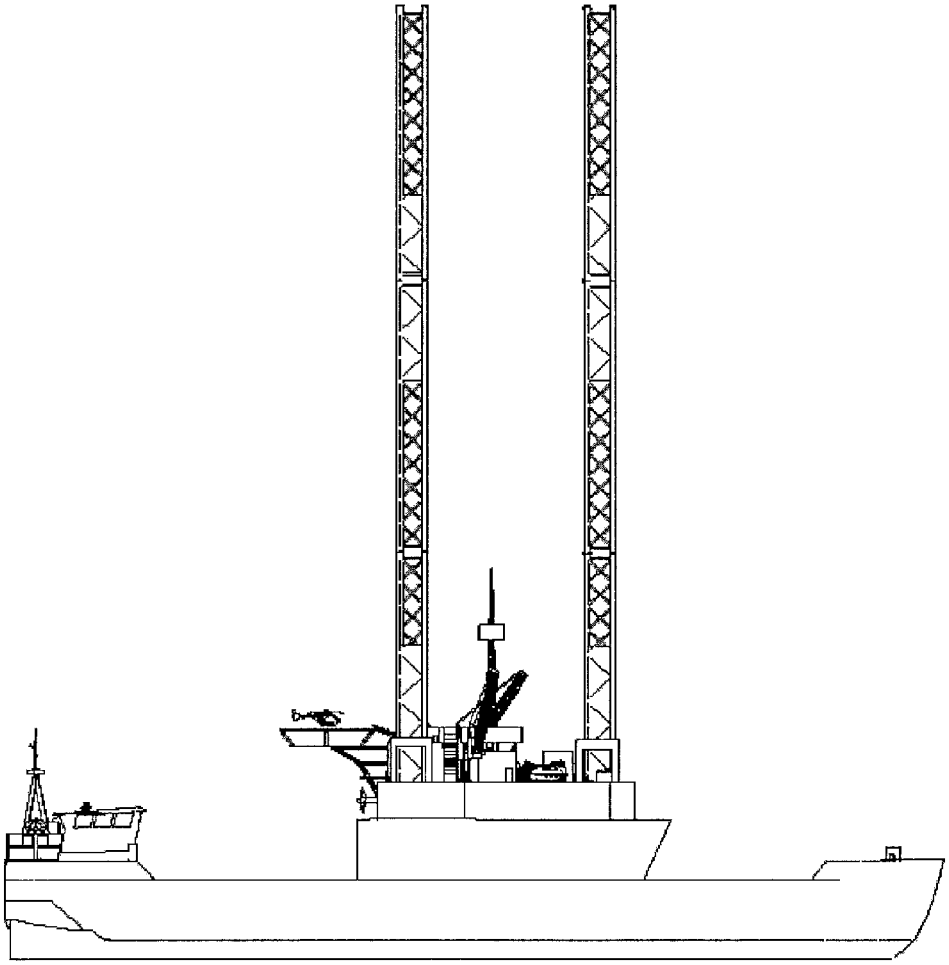
FIG. 6 is a side view of dry towing of a floating type self-lifting drilling platform according to a preferred embodiment of the present application.

As shown in FIG. 5 and FIG. 6, the platform may move to a predetermined sea area in two manners, wet towing or dry towing. Before the towing, water ballast in the main deck 1, the lower hollow sealing body 63 and floating cushion 7 is adjusted, and the lifting mechanism 5 lowers the main deck 1 to be overlapped with the upper part of the floating cushion 7. After arriving the preset sea area, the water ballast in the main deck 1 is drained, the water ballast in the lower hollow sealing body 63 and the floating cushion 7 is further adjusted, and at the same time, the lifting mechanism 5 is used to lower the pile legs 6 to proper heights, so that the water line is located in the height range of the upper hollow sealing body 61. Then, the lifting mechanism 5 is used to adjust the gap height between the main deck 1 and the sea surface, and the anchor chains 10 are dropped for positioning. The lower ends of the anchor chains 10 extend to the seabed and are fixed by the anchors. After being positioned on the sea, the platform may be ready for operation.

The platform of the present application is flexible in moving, strong in adaptability, and high in reliability. The number of current self-lifting type drilling platforms is large, but a lot of the platforms in service cannot be continuously used due to the service lives of pile legs and pile shoes, and there will be a large number of self-lifting type drilling platforms retire in future ten years. The cost of building a new platform is high. However, the present application may be used to modify the lower part structure of the existing self-lifting type platforms, the pile shoes are removed, an additional floating cushion is added, and the pile legs are modified; meanwhile, a small part of the main deck is modified, which will greatly reducing the manufacturing cost, thereby achieving the effect of prolonging the service life of the platforms and reducing the cost of oil and gas companies. More important, after the modification, the platform becomes a floating device, which has greatly increased depth and range of operation sea area, breaks through the current limit of the platform before the modification that it can only operate in shoal water of the continental shelf having the water depth not exceeding 150 meters, and can be used in a sea area having the water depth within 500 meters. Definitely, the present application is also applicable to newly building a marine drilling platform. During the operation, the center of gravity of the whole platform system of the present application is lower than the centre of buoyancy the platform has good stability. Moreover, because of the floating cushion, the heaving is effectively reduced, thereby having a good movement performance. The floating cushion also has a large oil storage capability.

The above descriptions are further detailed illustrations of the present application made through the preferred embodiments, and it cannot be considered that the specific implementation of the present application is limited to the descriptions. For persons skilled in the art of the present application, various equivalent replacements or obvious variations having the same performance or usage may further be made without departing from the spirit of the present application, which shall all fall within the protection scope of the present application.

What is claimed is:

1. A floating type self-lifting drilling platform, comprising: a main deck and an upper structure thereof, a floating cushion, pile legs, a mooring system and a lifting mechanism, wherein the upper structure comprises a module selected from the group consisting of a drilling module, a production module, and a drilling and production module;

wherein the floating cushion is located under the main deck, the area and thickness of the floating cushion are both greater than those of the main deck, a middle part of the floating cushion is provided with a moon pool as a passage for the module to pass, and the inner part of the floating cushion is partitioned into multiple cabins;

wherein there are three pile legs, a main structure of each of the pile legs is a triangular truss structure, a bottom part of each of the pile legs is rigidly and fixedly connected with the floating cushion, the main deck lifts vertically along the pile legs through the lifting mechanism and is fixed at a preset height, each of the pile legs comprises an upper hollow sealing body, a lower hollow sealing body and a middle section, the upper hollow sealing body and the lower hollow sealing body are both formed by soldering steel plates along the triangular truss structure, the middle section is located between the upper hollow sealing body and the lower hollow sealing body, and the middle section is still of a triangular truss structure through which water can pass; and wherein during the operation, the center of gravity of the floating type self-lifting drilling platform is lower than the centre of buoyancy, and the water line is located within the height range of the upper hollow sealing body and is positioned through the mooring system.

2. The floating type self-lifting drilling platform according to claim 1, wherein the port, starboard and stern of the floating cushion are correspondingly parallel to the port, starboard and stern of the main deck; and the front end of the floating cushion is an inclined surface tilting inwards from a top surface of the floating cushion towards a bottom surface of the floating cushion.

3. The floating type self-lifting drilling platform according to claim 1, wherein cabins in the floating cushion comprise an oil storage cabin, a water ballast cabin, a pump cabin and a sealed cabin, and the sealed cabin is filled with solid high-density metal.

4. The floating type self-lifting drilling platform according to claim 1, wherein the lower hollow sealing body is communicated with the internal of the floating cushion, the internal of the lower hollow sealing body is also partitioned into cabins, and the cabins in the lower hollow sealing body comprise a water ballast cabin or an oil storage cabin.

5. The floating type self-lifting drilling platform according to claim 1, wherein the floating type self-lifting drilling platform further comprises a propeller, and the propeller is disposed at an outer side of the stern of the main deck.

6. The floating type self-lifting drilling platform according to claim 2, wherein the angle of inclination of the inclined surface is 30° to 60°.

7. The floating type self-lifting drilling platform according to claim 1, wherein the mooring system is a multi-anchor chain distributed mooring system, at least two anchor chains are connected to the upper hollow sealing body of each pile leg, and at least six anchor chains are connected to the floating cushion.

8. The floating type self-lifting drilling platform according to claim 1, wherein the pile legs are arranged into triangles, and are symmetric at the port and the starboard.

9. The floating type self-lifting drilling platform according to claim 1, wherein when the floating type self-lifting drilling platform comprises the production module, the production module comprises a dry-type tree production system.

10. The floating type self-lifting drilling platform according to claim 1, wherein when the floating type self-lifting drilling platform encounters a storm during the operation, the floating type self-lifting drilling platform keeps the draft, and the lifting mechanism lifts the main deck to adjust the gap height between the main deck and the sea surface.

11. A floating type self-lifting drilling platform, comprising: a main deck, a floating cushion, pile legs, a mooring system and a lifting mechanism;

wherein the floating cushion is located under the main deck, the area and thickness of the floating cushion are both greater than those of the main deck, a middle part of the floating cushion is provided with a moon pool as a passage, and the inner part of the floating cushion is partitioned into multiple cabins;

wherein there are three pile legs, a main structure of each of the pile legs is a triangular truss structure, a bottom part of each of the pile legs is rigidly and fixedly connected with the floating cushion, the main deck lifts vertically along the pile legs through the lifting mechanism and is fixed at a preset height, each of the pile legs comprises an upper hollow sealing body, a lower hollow sealing body and a middle section, the upper hollow sealing body and the lower hollow sealing body are both formed by soldering steel plates along the triangular truss structure, the middle section is located between the upper hollow sealing body and the lower hollow sealing body, and the middle section is still of a triangular truss structure through which water can pass; and wherein during the operation, the center of gravity of the floating type self-lifting drilling platform is lower than the centre of buoyancy, and the water line is located within the height range of the upper hollow sealing body and is positioned through the mooring system.

12. The floating type self-lifting drilling platform according to claim 11, wherein the port, starboard and stern of the floating cushion are correspondingly parallel to a port, starboard and stern of the main deck; and a front end of the floating cushion is an inclined surface tilting inwards from a top surface of the floating cushion towards a bottom surface of the floating cushion.

13. The floating type self-lifting drilling platform according to claim 11, wherein cabins in the floating cushion comprise an oil storage cabin, a water ballast cabin, a pump cabin and a sealed cabin, and the sealed cabin is filled with solid high-density metal.

14. The floating type self-lifting drilling platform according to claim 11, wherein the lower hollow sealing body is communicated with the internal of the floating cushion, the internal of the lower hollow sealing body is also partitioned into cabins, and the cabins in the lower hollow sealing body comprise a water ballast cabin or an oil storage cabin.

15. The floating type self-lifting drilling platform according to claim 11, wherein the floating type self-lifting drilling platform further comprises a propeller, and the propeller is disposed at an outer side of the stern of the main deck.

16. The floating type self-lifting drilling platform according to claim 12, wherein the angle of inclination of the inclined surface is 30° to 60°.

17. The floating type self-lifting drilling platform according to claim 11, wherein the mooring system is a multi-anchor chain distributed mooring system, at least two anchor chains are connected to the upper hollow sealing body of each pile leg, and at least six anchor chains are connected to the floating cushion.

18. The floating type self-lifting drilling platform according to claim 11, wherein the pile legs are arranged into triangles, and are symmetric at the port and the starboard.

19. The floating type self-lifting drilling platform according to claim 11, wherein when the floating type self-lifting drilling platform encounters a storm during the operation, the floating type self-lifting drilling platform keeps the draft, and the lifting mechanism lifts the main deck to adjust the gap height between the main deck and the sea surface.

* * * * *